US009302866B1

(12) United States Patent
Manor et al.

(10) Patent No.: US 9,302,866 B1
(45) Date of Patent: Apr. 5, 2016

(54) PICK MECHANISM PICK ROLL TIRE HAVING MULTIPLE TREAD WIDTHS

(71) Applicant: Lexmark International, Inc., Lexington, KY (US)

(72) Inventors: Adam Thomas Manor, Lexington, KY (US); Timothy Marc Brown, Lexington, KY (US)

(73) Assignee: Lexmark International, Inc., Lexington, KY (US)

( * ) Notice: Subject to any disclaimer, the term of this patent is extended or adjusted under 35 U.S.C. 154(b) by 0 days.

(21) Appl. No.: 14/629,780

(22) Filed: Feb. 24, 2015

(51) Int. Cl.
*B65H 3/06* (2006.01)

(52) U.S. Cl.
CPC ..... *B65H 3/0638* (2013.01); *B65H 3/0669* (2013.01)

(58) Field of Classification Search
CPC ..... B65H 3/06; B65H 3/0638; B65H 9/004; B65H 9/04; B65H 9/06; B65H 2404/1112; B65H 2404/1141; B65H 2404/137; B65H 2404/19; B65H 3/0669
USPC ..... 271/119, 241, 245; 492/30, 38
See application file for complete search history.

(56) References Cited

U.S. PATENT DOCUMENTS

| | | | | |
|---|---|---|---|---|
| 5,882,004 | A * | 3/1999 | Padget | B65H 3/0607 271/119 |
| 8,376,351 | B2 * | 2/2013 | Ishikura | B65H 3/0638 271/119 |
| 2005/0253325 | A1 * | 11/2005 | Ogaya | B65H 3/0638 271/119 |
| 2006/0180988 | A1 * | 8/2006 | Yorimoto | B65H 1/08 271/119 |
| 2010/0013144 | A1 * | 1/2010 | Seike | G03G 15/6511 271/119 |
| 2010/0044951 | A1 * | 2/2010 | One | B65H 1/266 271/10.11 |

* cited by examiner

*Primary Examiner* — David H Bollinger
(74) *Attorney, Agent, or Firm* — John Victor Pezdek

(57) ABSTRACT

A center-fed media feed system including a media sheet pick mechanism having a hub-mounted D-shaped pick tire having variable tread width along the outer circumference thereof and a media aligner downstream of the pick mechanism. The nip of the pick tire contacting a media sheet is disposed at a first predetermined distance from the media aligner. A wide tread portion initially contacts a leading edge portion of the media sheet providing a first media feeding force to move the media sheet toward the media aligner and, at a second predetermined distance between the leading edge of the media and the media aligner, a narrow tread portion of the pick tire contacts the media so as to provide a reduced media feeding force, allowing the media sheet to align to the media aligner and then be fed into a feed nip in the media aligner or a downstream feed roll pair.

27 Claims, 10 Drawing Sheets

PICK MECHANISM PICK ROLL TIRE HAVING MULTIPLE TREAD WIDTHS

CROSS REFERENCES TO RELATED APPLICATIONS

None.

STATEMENT REGARDING FEDERALLY SPONSORED RESEARCH OR DEVELOPMENT

None.

REFERENCE TO SEQUENTIAL LISTING, ETC.

None.

BACKGROUND

1. Field of the Disclosure

The present disclosure relates generally to a media feed system of an image forming device, and, in particular, to a pick roll of a pick mechanism of the media feed system.

2. Description of the Related Art

In prior art media feed assemblies, a pick mechanism is used in combination with a downstream aligner for feeding sheets of media into an image forming device. The aligner ensures that the media being fed by the pick mechanism, such as a pick roll, has no misalignment, such as paper skew, upon reaching, contacting or passing through a downstream feed roll pair. In general, while the pick mechanism feeds media in a media feed direction along a media path thereof, a leading edge of fed media is aligned by contact with the aligner positioned transverse a media feed direction. The pick mechanism continues to feed the media to the downstream feed roll pair. The pick mechanism may use a D-roll as is known in the art to feed a media sheet into the downstream aligner. The D-roll has a pick tire having a given tread width and a flat portion when the D-roll is no longer in contact with the media sheet being feed. The flat portion allows a downstream feed roll pair to feed the media sheet with no feeding force being applied by the D-roll of the pick mechanism that may skew the media sheet.

When feeding the media sheet, the D-roll rotates and moves the media sheet in the media feed direction toward the aligner. A bubble forms in a portion of the media sheet contacting the aligner and the leading edge aligns with the aligner. In this manner, each media sheet is fed along the media feed path with proper alignment. During bubble formation and leading edge alignment, the media sheet is still being fed by the pick roll which is designed to provide sufficient force to move the largest width of media useable in the image forming device. That same force is also applied to the narrower media types. Because of this, the skew of wide media is more readily corrected than that of narrow media. In particular, a longer moment arm is created when the leading edge of the wide media contacts the aligner and provides sufficient torque to allow the media to slip relative to the pick roll and pick tire. Whereas with narrow media a smaller moment arm is created when the leading edge contacts the aligner and provides less torque to overcome the force supplied by the pick roll and pick tire, and, as a result, skewing may not be completely corrected. Also a less stiff bubble is formed with the wide media as compared to a stiffer bubble formed in narrower media. It would be desirable to have a pick mechanism and pick roll in combination with an aligner that could correct skew in both wide and narrow media.

SUMMARY

Disclosed is a media feed system for an image forming device and a media pick mechanism each utilizing a D-shaped pick roll including a pick tire having multiple tread width portions to provide different media feeding forces. The media feed system comprises a frame, a media support for holding a media stack having one or more media sheets and abutting the frame, a shaft rotatably mounted to the frame and positioned above the media stack, the shaft operably coupleable to a drive source in the image forming device, and a pick roll coupled to the shaft and rotatable therewith to pick a sheet of media from the media stack and feed the picked media sheet into a media feed path in a media feed direction, The pick roll includes a D-shaped hub coupled to the shaft, and a D-shaped pick tire mounted on the hub. The pick tire is rotated to contact the media sheet of the media stack at a pick position to pick and move the media sheet in the media feed direction. The pick tire has a wide tread portion contiguous with a narrow tread portion that has a tread width that is less than a width of the wide tread portion. The wide tread portion has a first circumferential length and the narrow tread portion has a second circumferential length. The wide tread portion applies a first media feeding force that is greater than a second media feeding force applied by the narrow tread portion.

The system also includes an aligner positioned transverse to the media feed path. The aligner aligns a leading edge of the picked media sheet to be transverse to the media feed direction. The aligner is disposed downstream of the pick position at a distance that is less than a sum of the first and second circumferential lengths and greater than the first circumferential length. In one form, the aligner is a swing gate and in another the aligner is a pair of bump align feed rolls.

During feeding of a media sheet, the pick tire initially contacts the media sheet at the pick position with the wide tread portion and the wide tread portion applies the first media feeding force to the media sheet to move the sheet in the media feed direction and into the media feed path. As the pick tire is further rotated the narrow tread portion contacts the picked media sheet to apply the second media feeding force allowing the leading edge of the media sheet to contact and align with the aligner and be fed into the nip of a downstream feed roll pair.

The pick tire may comprise three separate tire bands—an inner tire band abuttingly positioned between two outer tire bands. The inner tire band has a circumferential tread length substantially equal to the sum of the first and second circumferential lengths while the two outer bands each having a circumferential tread length substantially equal to the first circumferential length. The hub may have one of an axial key and an axial keyway and each of the three tire bands may have a corresponding one of an axial keyway and an axial key. In another form the hub has a width that is greater than a sum of widths of the center or inner band and the two outer bands. The center or inner band is equidistantly spaced apart from the two outer bands. In this form the inner band may be positioned between a first and a second alignment member radially depending from the hub and positioned about a centerline of the hub while one of the two outer bands is positioned in between a left flange of the hub and a third alignment member radially depending from the hub and spaced apart from the left flange of the hub and the other of the two outer bands is positioned in between a right flange of the hub and a fourth alignment member radially depending from the hub and spaced apart from the right flange of the hub.

In still a further form, the pick tire comprises a center or inner band positioned in abutment between two outer bands. The inner band and the two outer bands are substantially identical with each band having a circumferential tread length substantially equal to the first circumferential length and an overall circumferential length equal to the sum of the first and second circumferential lengths. The inner band is positioned on the hub opposite to or reversed with respect to each of the two outer bands.

The hub may include a rim and a shaft coupler removably coupled to the shaft. The rim is removably attached to the shaft coupler, and, when attached to the shaft coupler, rotatable with the shaft.

BRIEF DESCRIPTION OF THE DRAWINGS

The above-mentioned and other features and advantages of the disclosed embodiments, and the manner of attaining them, will become more apparent and will be better understood by reference to the following description of the disclosed embodiments in conjunction with the accompanying drawings.

FIG. 7 illustrates the initial picking of a media sheet by the pick mechanism; FIG. 8 illustrates the initial feeding of the picked media sheet; FIG. 9 illustrates bubble formation at a media aligner; FIG. 10 illustrates the media sheet at the downstream feed roll pair; and FIG. 11 shows the fed media sheet released by a pick roll of the pick mechanism.

DETAILED DESCRIPTION

Figure 1:
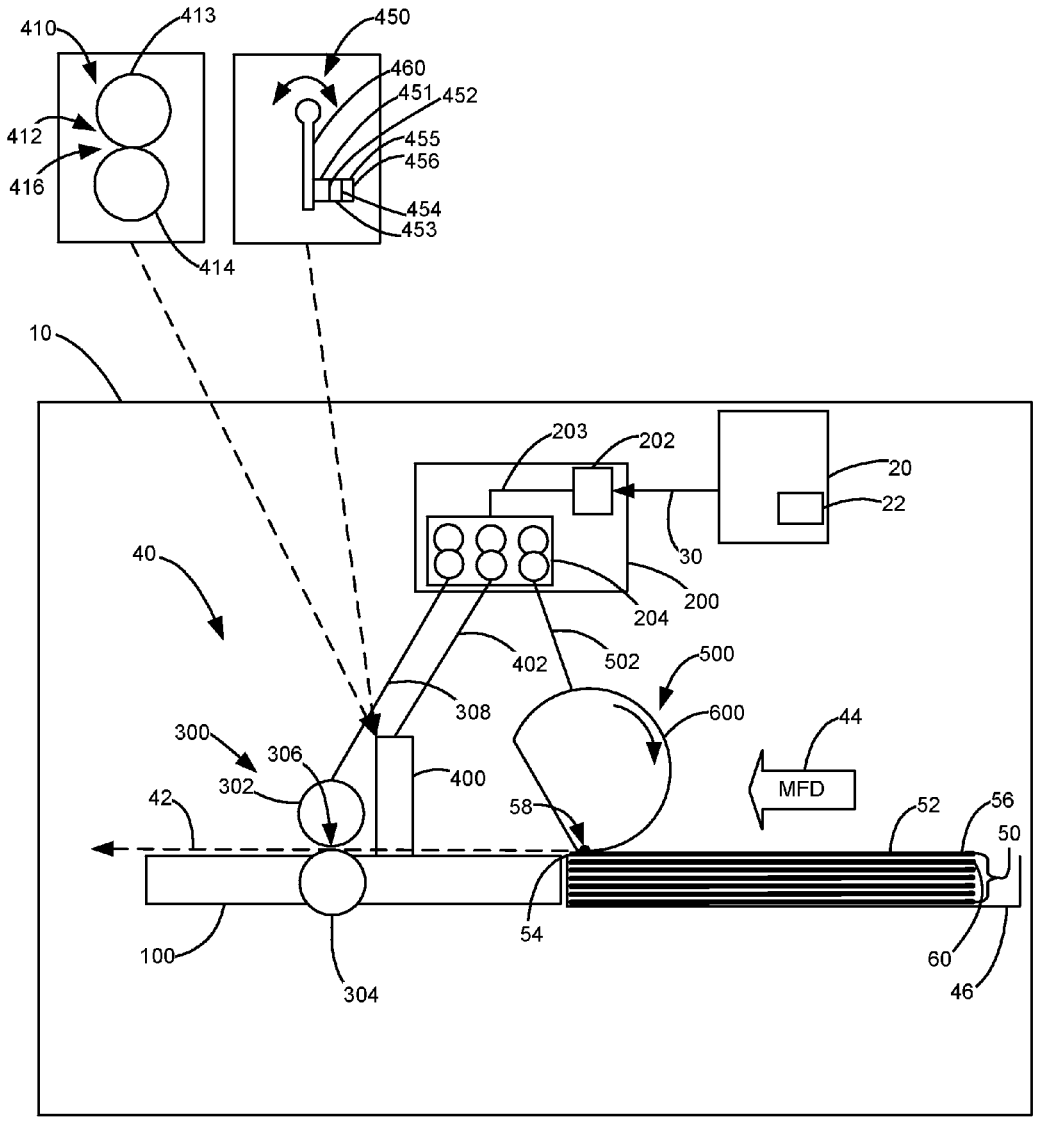
FIG. 1 is a schematic depiction of a media feed system having insets showing two example embodiments of an aligner.

It is to be understood that the present disclosure is not limited in its application to the details of construction and the arrangement of components set forth in the following description or illustrated in the drawings. The present disclosure is capable of other example embodiments and of being practiced or of being carried out in various ways. Also, it is to be understood that the phraseology and terminology used herein is for the purpose of description and should not be regarded as limiting. As used herein, the terms "having", "containing", "including", "comprising", and the like are open ended terms that indicate the presence of stated elements or features, but do not preclude additional elements or features. The articles "a", "an" and "the" are intended to include the plural as well as the singular, unless the context clearly indicates otherwise. The use of "including," "comprising," or "having" and variations thereof herein is meant to encompass the items listed thereafter and equivalents thereof as well as additional items.

Unless limited otherwise, the terms "connected," "coupled," and "mounted," and variations thereof herein are used broadly and encompass direct and indirect connections, couplings, and mountings. In addition, the terms "connected" and "coupled" and variations thereof are not restricted to physical or mechanical connections or couplings. Spatially relative terms such as "top", "bottom", "front", "back", "rear" and "side" "under", "below", "lower", "over", "upper", "left", "right", and the like, are used for ease of description to explain the positioning of one element relative to a second element as viewed in the accompanying figures. These terms are intended to encompass different orientations of the device in addition to different orientations than those depicted in the figures. Further, terms such as "first", "second", and the like, are also used to describe various elements, regions, sections, etc. and are also not intended to be limiting. Like terms refer to like elements throughout the description.

In addition, it should be understood that example embodiments of the present disclosure may include both hardware and electronic components or modules that, for purposes of discussion, may be illustrated and described as if the majority of the components were implemented solely in hardware. However, one of ordinary skill in the art, and based on a reading of this detailed description, would recognize that, in at least one example embodiment, the electronic based aspects of the invention may be implemented in software. As such, it should be noted that a plurality of hardware and software-based devices, as well as a plurality of different structural components may be utilized to implement the invention. Furthermore, and as described in subsequent paragraphs, the specific mechanical configurations illustrated in the drawings are intended to exemplify example embodiments of the present disclosure and that other alternative mechanical configurations are possible.

The term "image forming device" includes optical scanning devices, such, as optical reduction type using a combination of lens, mirror and a CCD (Charge Coupled Device) array or CIS (Contact Image Sensors) type, and any printing device, such as, color and black-and-white copiers, color and black-and-white printers, and multifunction devices that incorporate multiple functions such as scanning, copying, and printing capabilities in one device. Such printing devices may utilize ink jetting, dot matrix printing, dye sublimation, electrophotographic transfer, and any other suitable print processes The term "media" as used herein encompasses any material for receiving an image or containing an image. Unless otherwise stated, media is generally rectangular having a top surface or top side and a bottom surface or bottom side. The "leading edge" of a media is the first portion to enter a media feed path. The "trailing edge" of media is the last portion of a media to enter a media feed path. The "side edges" of a media or the "left edge" and "right edge" of a media refer to the edges of the media that are parallel to the media feed path as viewed in the media feed direction. A "margin" is an area of a surface or side of the media beginning at an edge and extending inwardly to a predetermined height or width. A "top margin" extends from the leading edge to a given height. A "bottom margin" extends from the trailing edge to a given height. A "side margin" extends from a side edge to a given width. Typically as viewed from a media feed direction, a "right margin" extends from the right edge to a given width and a "left margin" extends from the left edge. The area of the media bounded by the margins may be termed the "image area" containing text or images to be scanned or to be printed, depending on context.

The term "media feed path" is the route along which media travels in an image forming device and refers to the path from a media input area to a media output area of the image forming device or any portion thereof. The term "media feed direction" or "MFD" indicates the direction that media travels within the image forming device or a subassembly thereof.

Unless otherwise indicated "a media feed roll pair" consists of a driven roll and an idler roll that are axially aligned and which form a nip or feed nip therebetween through which media is moved along the media feed path. The driven roll is operably coupled to a drive source in the image forming device, and, when rotated in one direction, will feed a media in the media feed direction, and, when rotated in an opposite direction, may act to block the feeding of media in the media feed direction or feed the media in a direction opposite to the media feed direction.

The term "communication link" is used to generally refer to structure that facilitates electronic communication between multiple components, and may operate using wired or wireless technology. Communications among components may be done via a standard communication protocol, such as for example, universal serial bus (USB), Ethernet or IEEE 802.xx. A controller includes a processor unit and associated memory and may be formed as one or more Application Specific Integrated Circuits (ASICs). The associated memory may be, for example, random access memory (RAM), read only memory (ROM), and/or non-volatile RAM (NVRAM). Alternatively, the associated memory may be in the form of a separate electronic memory (e.g., RAM, ROM, and/or NVRAM), a hard drive, a CD or DVD drive, or any memory device convenient for use with the controller. A controller may be, for example, a combined printer and scanner controller. A controller may be illustrated in the figures as a single entity but it is understood that the controller may be implemented as any number of controllers, microcontrollers and/or processor each having associated memory.

Figure 2:
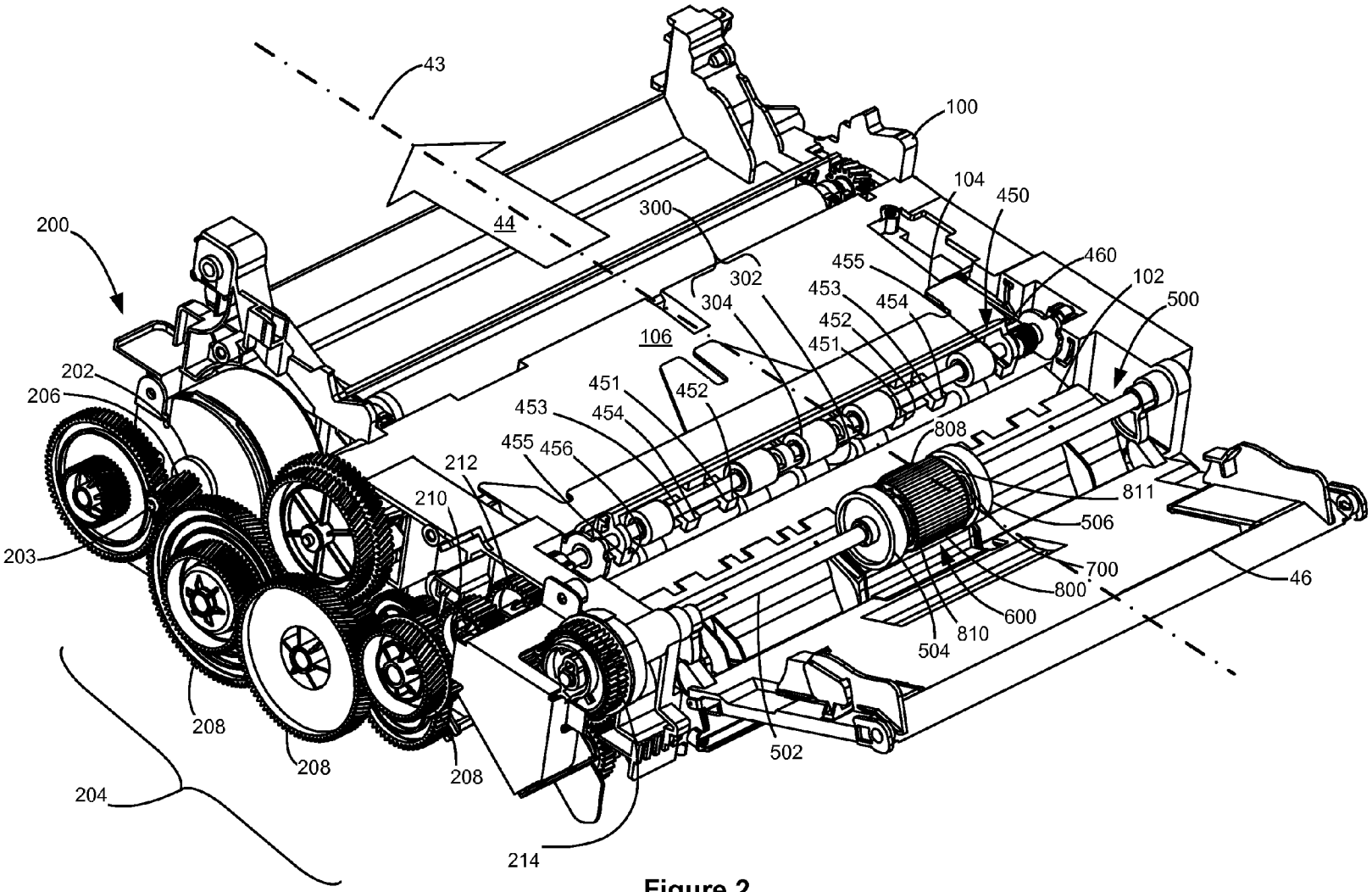
FIG. 2 is a side perspective view of one example embodiment of the media feed system of FIG. 1 using a gate aligner according to one example embodiment.
Figure 3:
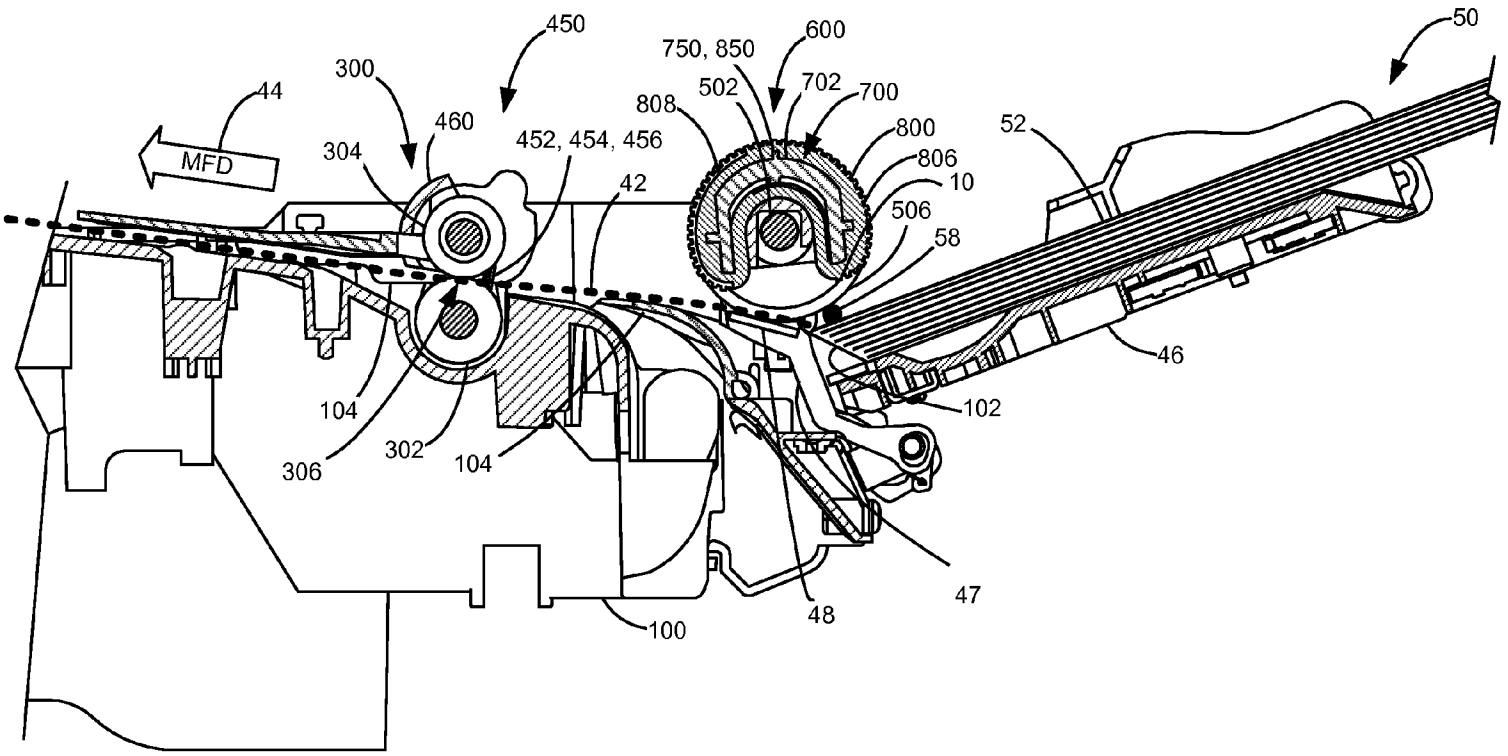
FIG. 3 is a side cross sectional view of the media feed system of FIG. 2.

A media feed system 40 using a multiple tread width pick roll is shown in FIGS. 1-3. A pick roll 600 of pick mechanism 500, in the form of a D-shaped roll or D-roll, is centered about at a centerline 43 of a media path 42. In imaging device 10, pick mechanism 500 using pick roll 600 feeds media stack 50 on media support 46 in a media feed direction 44 one sheet at a time. Pick roll 600 is mounted on drive shaft 502 that is engaged with gear train 204 that is driven via motor shaft 203 of motor 202 of drive train 200. Aligner 400 is coupled via member 402 to gear train 204. Downstream feed roll pair 300 comprised of driven roll 302 and idler roll 304 is coupled via member 308 to gear train 204. Controller 20 having associated memory 22 is communicatively coupled to motor 202 via communication link 30. To start media picking or feeding, a topmost media sheet 52 of media stack 50 is in contact with pick roll 600 at pick point 58 which is adjacent to and slightly upstream of leading edge 54 of topmost media sheet 52.

Pick roll 600 may be used in combination with either a downstream bump roll aligner 410 or gate aligner 450 (see insets of FIG. 1). Bump roll aligner 410 is formed by a feed roll pair 412 consisting of driven roll 413 and an idler roll 414 forming feed nip 416 therebetween. Gate aligner 450 is illustrated as having three spaced pairs of alignment arms 451, 453, 455 depending from a rotatable support 460 disposed upstream a feed roll pair 300. Alignment arm pairs 451, 453, 455 are centered about centerline 43. Alignment arm pair 455 is the outermost pair used with the widest media types used in media feed system 40, such as A4, Ledger or Letter sized media. Alignment pair 451 is the innermost pair and is used with the narrowest media used in media feed system 40, such as envelopes. Alignment pair 453 is positioned between alignment arm pairs 451 and 455 and is used with intermediate width media such as A6 sized media. Each of alignment arm pairs 451, 453, 455 has alignment faces 452, 454, 456, respectively used to contact leading edge 54 of media sheet 52. Alignment faces 452, 454, 456 are staggered or offset slightly from one another in the media feed direction 44. Alignment faces 452 is shown being farthest downstream while alignment faces 456 are the most upstream with alignment faces 454 being positioned intermediate alignment faces 452, 456. The amount of offset between adjacent alignment face pairs may be about 0.5 mm to about 1 mm.

Aligner 400, such as aligner 410 or 450, is positioned transverse to the media feed path 42 and the media feed direction MFD 44 and will be used to place in parallel alignment therewith a leading edge 54 of a topmost media sheet 52 that is fed from media stack 50. When feeding media sheet 52, pick roll 600 rotates clockwise (see curved arrow in FIG. 1) and moves media sheet 52 in media feed direction 44 along media path 42 toward aligner 400. As leading edge 54 of the fed media sheet 52 contacts aligner 400 a bubble 57 (see FIG. 9) is formed in a portion of media sheet 52 near leading edge 54 reducing stiffness in media sheet 52 and allowing leading edge 54 to align itself with aligner 400.

Referring to FIGS. 2-3, during media feeding, pick roll 600 feeds the leading edge 54 of media sheet 52 on media support 46 into media dam 102 and then along media path 42 formed by media guide surfaces 104 to aligner 450. Separator rolls 504, 506 mounted on shaft 502 outboard of pick roll 600 are used to block subsequent media sheets that may be shingled onto media sheet 52 from entering the media feed path 42 together with media sheet 52. Lift pad 48 on lift arm 47 forms a nip with pick roll 600 and separator rolls 504, 506. The diameter of pick roll 600 is slightly larger than that of separators rolls 504, 506 forming a slightly lower nip height than the nip heights formed by separator rolls 504, 506 and lift pad 48. Pick roll 600 pushes lift arm 47 and lift pad 48 downwardly. Pick roll 600 includes, a hub assembly 700 having a pick tire 800 having a wide tread portion 806 followed by a narrow tread portion 808, left and right edges 810, 811 and leading and trailing edges 812, 813 (see FIG. 4). Leading and trailing edges 812, 813 are referenced to the rotation of pick roll 600 that will feed a media sheet in the media feed direction 44.

When gate aligner 450 is used, the leading edge 54 of the media sheet 52 contacts one of alignment surface pairs 452, 454, 456 provided by alignment arm pairs 451, 453, 455, respectively, depending on its width. When bump aligner 410 is used, leading edge 54 contacts nip 416 or one of feed rolls 413, 414 of the bump aligner 410. As is known feed rolls 413, 414 may be rotated counter to the media feed direction 44 to assist with bubble formation. Thereafter, gate aligner 450, when used, is rotated out of media feed path 42 and media sheet 52 proceeds into downstream feed roll pair 300. Where bump aligner 410 is used, bump aligner 410 would be used in lieu of downstream feed roll pair 300 and feed rolls 413, 414 would be rotated to send the media sheet in the media feed direction 44. In this manner, each media sheet of media stack 50 is fed along media feed path 42 with proper alignment.

Drive train 200 in one form consists of motor 202 having gear 206 mounted on its output shaft 203. Gear 206 meshes with one or more intermediate gears 208 that in turn mesh with drive gear 210 affixed to driven feed roll 302. Drive gear 212 is affixed to support 460 of gate aligner 450, and drive gear 214 affixed to shaft 502 of pick mechanism 500. Gears 206, 208, 210, 212, and 214 comprise gear train 204. Motor 202 is reversible to enable gate aligner 450 to be rotated into and out of media path 42. While a single motor 202 is shown it will be understood that each of drive gears 210, 212, 214 may be driven by an individual motor.

Figure 4:
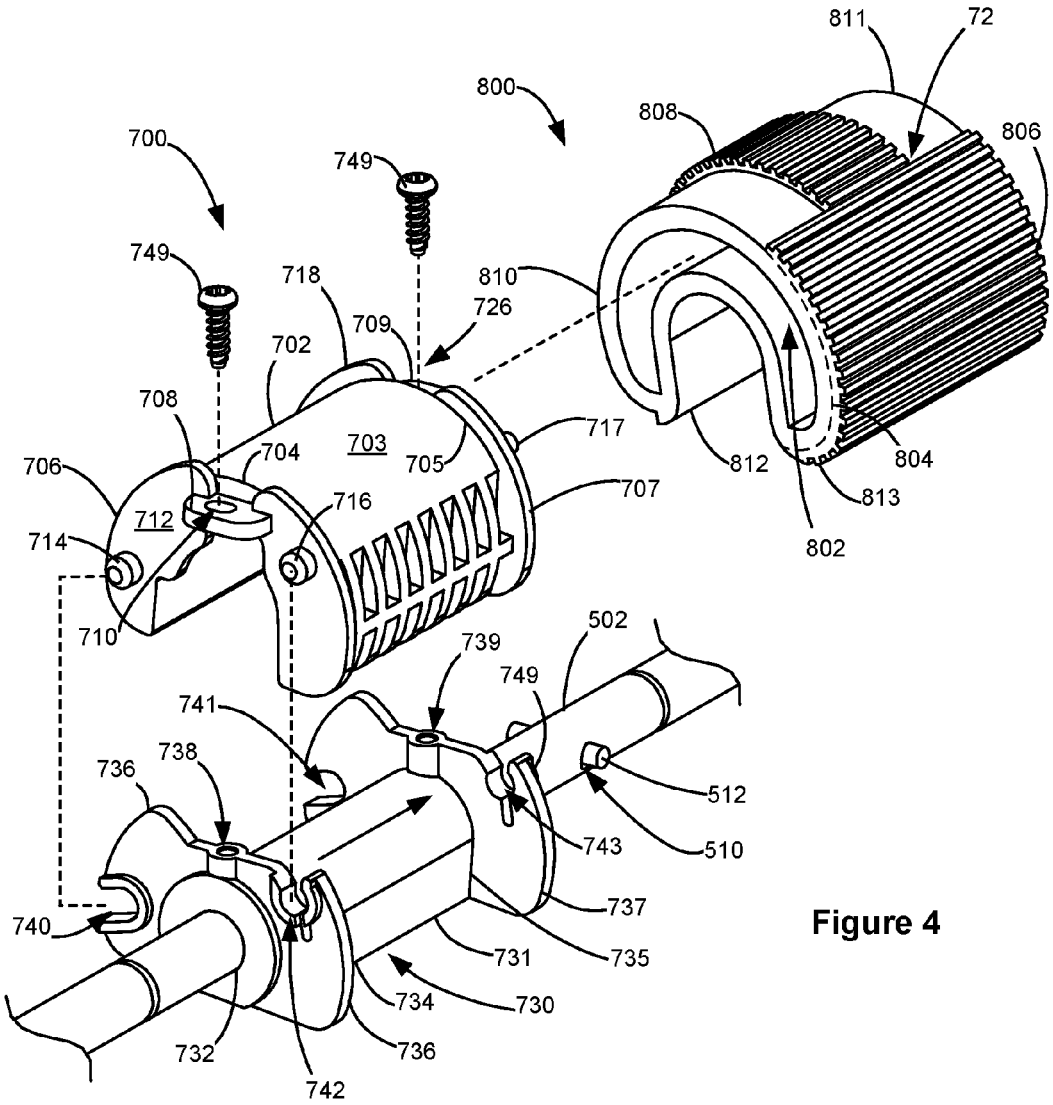
FIG. 4 is an exploded left side perspective view of the pick roll of FIG. 2 having a hub and pick tire according to one example embodiment.
Figure 5:
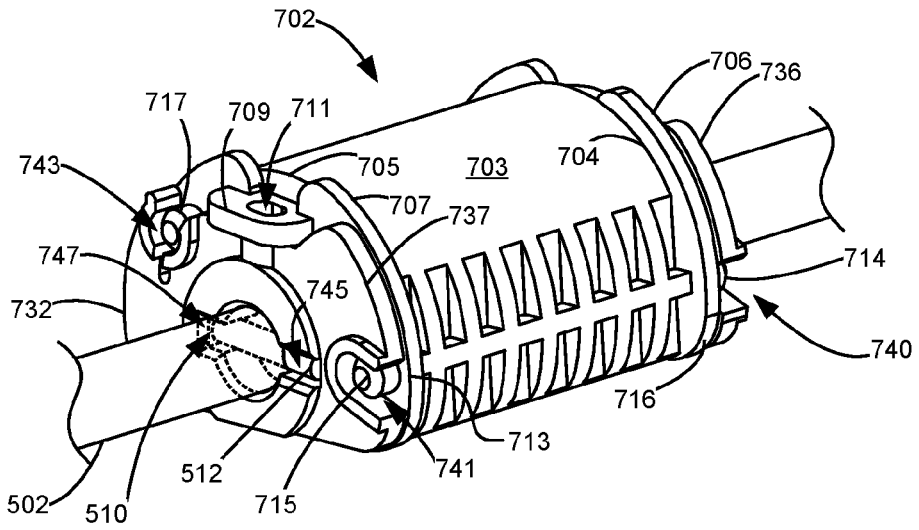
FIGS. 5-6 are right and left side perspective views of a hub of the pick roll of FIG. 4 coupled to a drive shaft of a pick mechanism.
Figure 6:
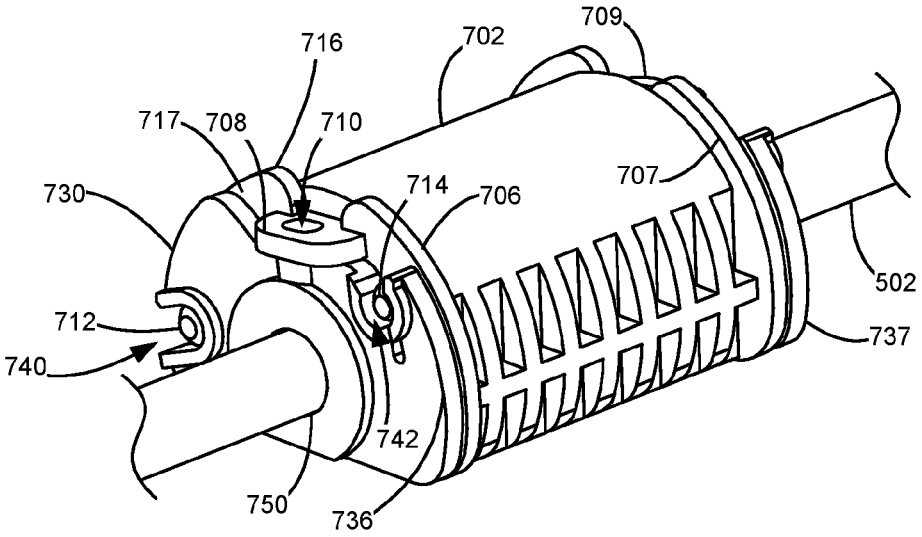

FIGS. 4-6 illustrate an example embodiment of a pick roll of the present disclosure. Pick roll 600 comprises a hub assembly 700 having one embodiment of a D-shaped pick tire 800 mounted therein. Pick roll 600, hub assembly 700 and pick tire 800 are illustrated in a position reverse to their normally operating position shown in FIG. 2 and the reference to "right" and "left" are used with respect to pick roll 600, hub assembly 700 and pick tire 800 as shown in FIG. 2.

Hub assembly 700 comprises a D-shaped rim 702 removably attached to a shaft coupler 730. Rim 702 has a seating surface 703 between left and right ends 704, 705. Left and right radial flanges 706, 707 and left and right axial tabs 708, 709 are respectively mounted to left and right ends 704, 705. Left and right tabs 708, 709 have slots 710, 711, respectively extending therethrough. Provided on outer surface 712 of left flange 706 are axially extending coupling pins 714, 716 and provided on outer surface 713 of right flange 707 are axially extending coupling pins 715, 717.

Shaft coupler 730 has a body 731 having an opening 732 extending therethrough that is sized to receive therein shaft 502 of pick mechanism 500. Attached to left and right ends 734, 735 of body 731 are radially extending left and right support plates 736, 737, respectively. Support plates 736, 737 are generally rectangular in shape. Rim 702 is sized to be received between left and right support plates 736, 737. Left and right mounting holes 738, 739 are provided in respective top sides of left and right support plates 736, 737 and are aligned with left and right slots 710, 711 of rim 702 when rim 702 is mounted. Aligned slots 740, 741 and aligned snap-in cradles 742, 743 are provided in left and right support plates 736, 737. Slots 740, 741 are shown having a generally horizontal orientation and are provided along rear sides of support plates 736, 737 while snap-in cradles 742, 743 are generally vertically oriented and are provided in the top sides of support plates 736, 737 adjacent to their respective front sides. Also provided in right support plate 737 are opposed, aligned and radially extending slots 745, 747 that connect with opening 732.

Shaft 502 of pick mechanism 500 has a radial opening 510 therethrough which receives a coupling pin 512 having ends that radially extend from shaft 502. The ends of coupling pin 510 are received into opposed slots 745, 747 of right support plate 737 when shaft coupler 730 is slid onto shaft 502 as indicated by the arrow in FIG. 4. Shaft coupler 530 is sandwiched between separator rolls 504, 506 that, in turn, are axially held in place on shaft 502 by fasteners, such as C clips, that are affixed to shaft 502 as is known in the art.

Pick tire 800 has a D-shaped opening 802 provided therethrough that conforms to the shape of rim 702 and is sized to be seated between left and right flanges 706, 707. Rim 702 is received into opening 802 and pick tire 800 seats on seating surface 703 between left and right flanges 706, 707. During seating, pick tire 800 will expand slightly to pass over left or right flange 706, 707 and then snap into place on seating surface 703. For purposes of description pick tire 800 may be thought of as having a base portion 804 on which is provided a wide tread portion 806 beginning at leading edge 812 and a narrow thread portion 808 ending at trailing edge 813. A transition point 72 point between the two tread portions is empirically determined. Tread portions 806, 808 are contiguous and extend along the curved portion of pick tire 800. As shown in FIG. 4, wide tread portion 806 extends between left and right edges 810, 811 of tire base 804 while narrow tread portion 808 is illustrated as being centered between left and right edges 810, 811 and is also stepped inwardly from both edges. As shown, narrow tread portion 808 has a substantially constant width along its length. The widths of both tread portions are empirically determined to provide different magnitudes of media feeding forces. Wide tread portion 806 and narrow tread portion 808 have circumferential tread lengths designated TLw, TLn, respectively. The total tread length between leading and trailing edges 812, 813 is designated TLt and TLt=TLw+TLn. Typically, tire base 804 and respective wide and narrow tread portions 806, 808 would be molded as a single piece as is known in the art. Pick tire 800 may be molded from the following materials or other equivalent material: isoprene, neoprene, urethane rubbers, ethylene propylene diene terpolymer (EPDM) having a durometer of approximately 40 Shore A. The tread patterns on wide and narrow tread portions is illustrated as being grooves orientated to be transverse to the media feed direction 44. Other tread patterns and orientations may be used and the tread pattern should not be considered as a limitation of the present disclosure.

With pick tire 800 seated on rim 702, the assembly may be attached to shaft coupler 730. Couplings pins 714, 715 are slidably received into respective left and right slots 740, 741. The rim-tire assembly is rotated so that couplings pins 716, 717 may be snapped into left and right snap-in cradles 742, 743, respectively. Thereafter, respective fasteners 749, such as screws 749, would be received through left and right slots 710, 711 of left and right tabs 708, 709 and into left and right mounting holes 738, 739 of coupler 730. As pick tire 800 wears and requires replacement, rim 702 and pick tire 800 may be readily detached from shaft coupler 730 mounted on pick shaft 502 by simply removing fasteners 749 and unsnapping rim 702 from snap-in cradles 742, 743 without needing to disassemble pick mechanism 500.

Figure 7:
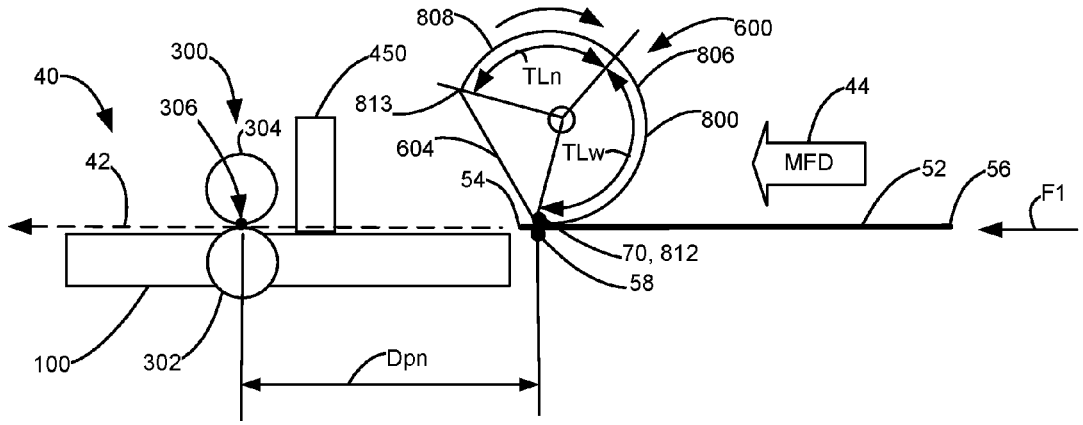
FIGS. 7-11 are schematic depictions of a media feed operation using the media feed system of FIG. 2 where.

FIGS. 7-11 illustrate a schematic sequence showing the picking of a media sheet using pick roll 600 with and pick tire 800. In FIG. 7, pick roll 600 is positioned at pick point 70 on pick tire 800 adjacent leading edge 812 thereof and at a pick point 58 on media sheet 52 that is adjacent to the leading edge 54 thereof. Pick points 58, 70 being coincident. Pick tire 800 on pick roll 600 is positioned at or near the beginning of the wide tread portion 806. Downstream of pick roll 600 on media feed path 42 is feed roll pair 300 having driven roll 302 and idler roll 304 forming feed nip 306 therebetween. Aligner 450 is positioned intermediate the leading edge 54 and feed roll pair. The distance between feed nip 306 and pick point 58 is designated Dpn where Dpn is chosen so that Dpn≤TLt. As pick roll 600 is rotated to move media sheet 52 in MFD 44, the wide tread portion 806 provides a first media feeding force F1 to media sheet 52. The magnitude of first media feeding force F1 is determined by the width of wide tread portion 806 and the speed of rotation of pick roll 600. As is known in the art, the speed of rotation of pick roll 600 may be varied depending on the width of media sheet 52 that is being picked.

Figure 8:
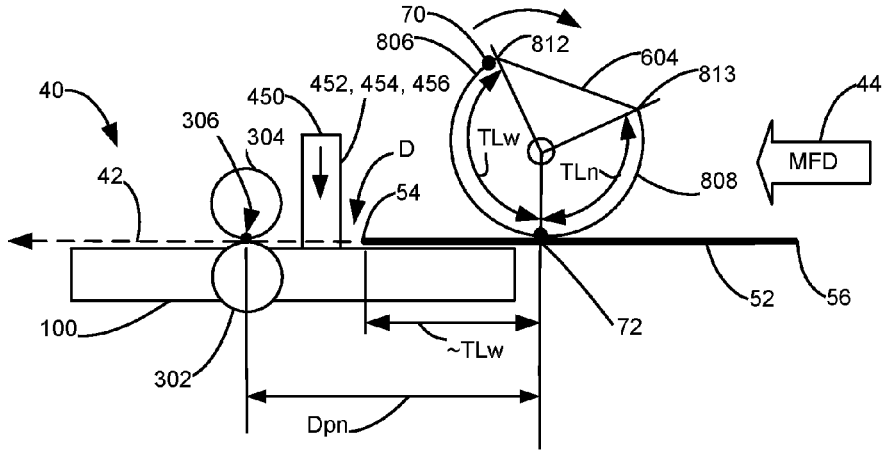

In FIG. 8 feeding of media sheet 52 along media feed path 42 has continued and pick roll 600 has been rotated to a transition point 72 between width tread portion 806 and narrow tread portion 808. The leading edge 54 of media sheet 52 has moved a distance toward aligner 450 that is approximately equal to TLw, and has placed leading edge 54 of media sheet 52 at a predetermined distance D upstream of aligner 450. At the transition point 72 a reduced media feeding force F2 is applied to media sheet 52 by pick tire 800. Assuming the same rotational speed for pick tire 800, the smaller surface area of the narrow tread portion results in a feeding force F2 being less than that of F1. However, feeding force F2 must still be of a magnitude to ensure bubble formation and as well being able to feed leading edge 54 into feed nip 306. Feeding force F2 is again empirically determined based on the media expected to be used.

Figure 9:
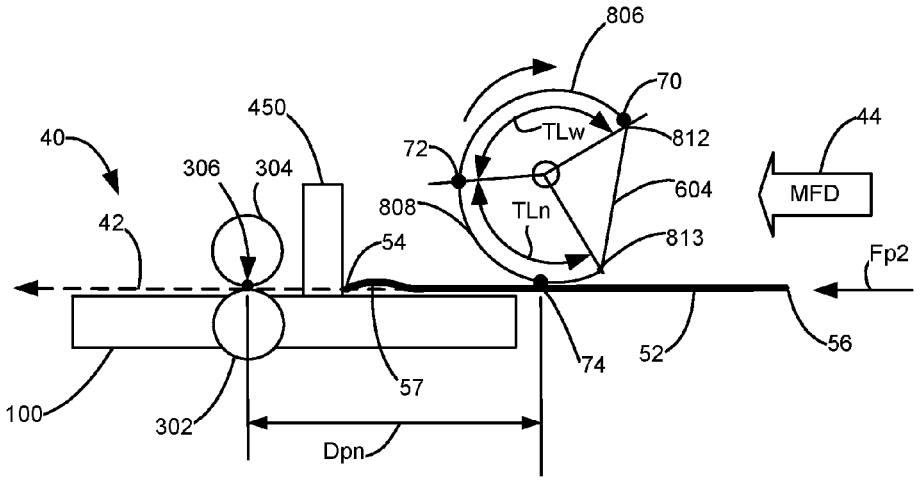

In FIG. 9 feeding of media sheet 52 along media feed path 42 has continued and pick roll 600 has been rotated to a bubble formation point 74 occurring within narrow tread portion 808 at which the leading edge 54 of media sheet 52 aligns itself with media aligner 450 (or, when used, with downstream bump aligner 410). The leading edge 54 of media sheet 52 has moved a distance that is greater than distance D and into contact with one of the alignment arm pairs of aligner 450 (or bump aligner 410) as previously described.

Figure 10:
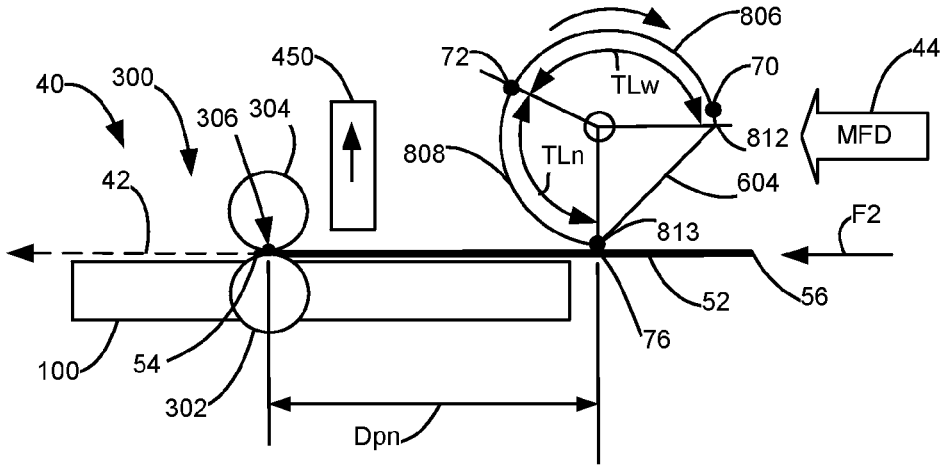
Figure 11:
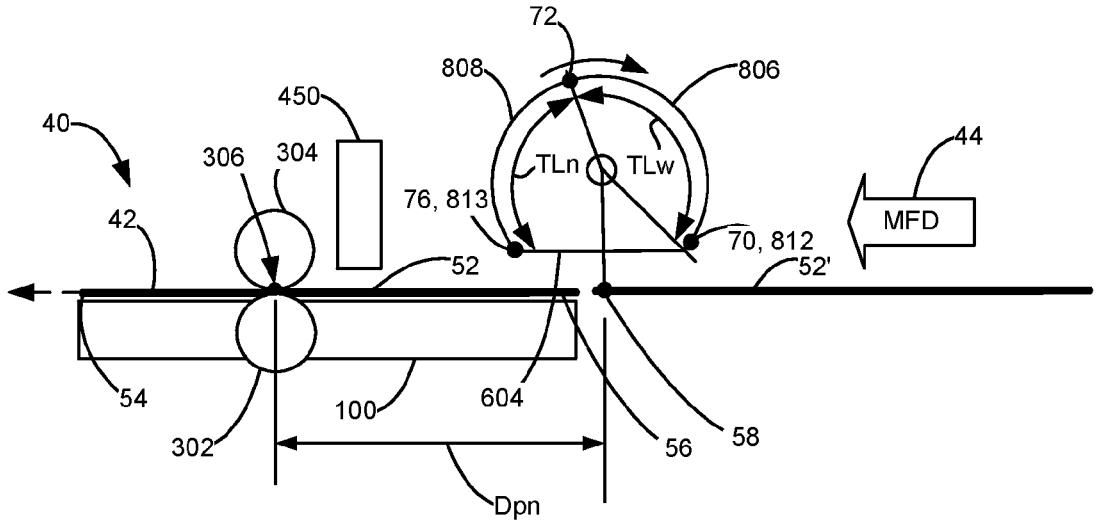

In FIG. 10, aligner 450 has been removed from media feed path 42 and the feeding of media sheet 52 along media feed path 42 has continued to where leading edge 54 of media sheet 52 has been ingested in feed nip 306 of feed roll pair 300. Pick roll 600 and pick tire 800 have been rotated to a release point 76 occurring adjacent the end of narrow tread portion 808 at which the flat 604 of pick roll 600 is reached. As shown in FIG. 11, subsequent to release point 76, the flat 604 of pick roll 600 is above media sheet 52. Pick point 70 of pick tire 800 is approaching pick point 58 on media sheet 52' which is the next media to be fed using media feed system 40 and the cycle repeats itself. The release of media sheet 52 from pick roll 600 and pick tire 800 ensures that pick roll 600 and pick tire 800 will not apply any forces that may deskew media sheet 52.

Figure 12:
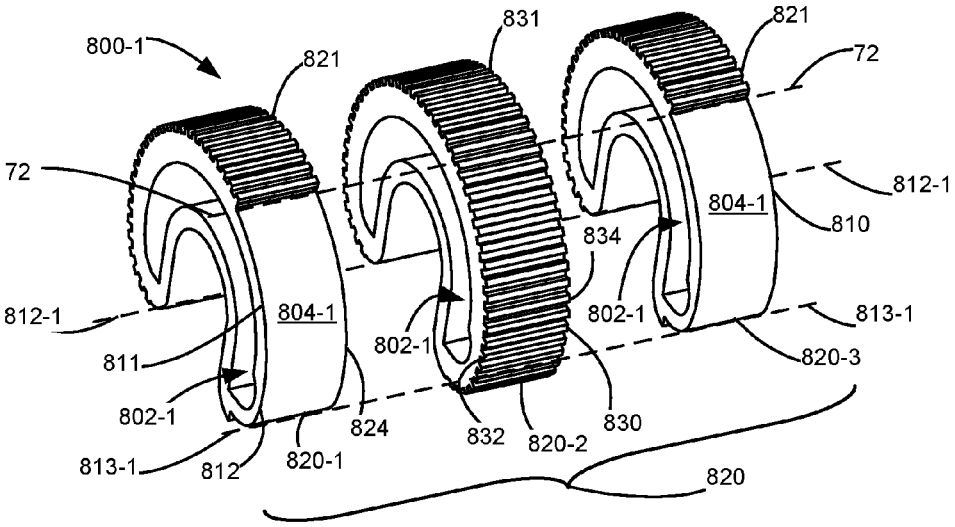
FIG. 12 is a perspective view of another example embodiment of a pick tire formed of three sections and useable with the pick roll of FIG. 4.
Figure 13:
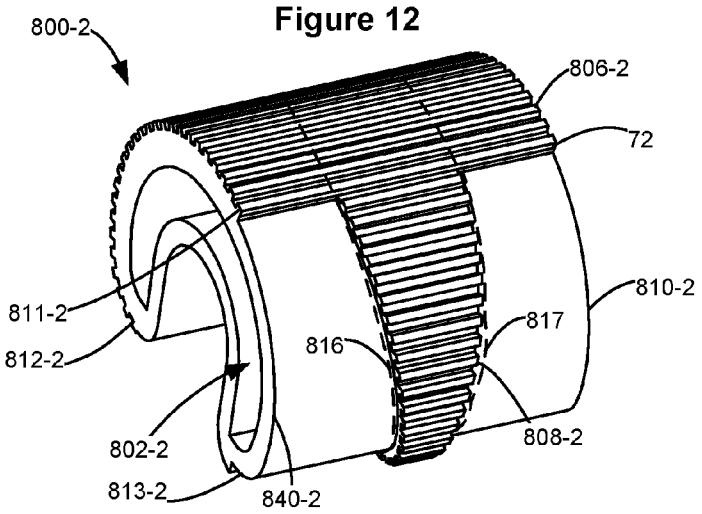
FIG. 13 is a perspective view of a second example embodiment of a pick tire having a stepped-in tapering tread pattern useable with the pick roll of FIG. 4.
Figure 14:
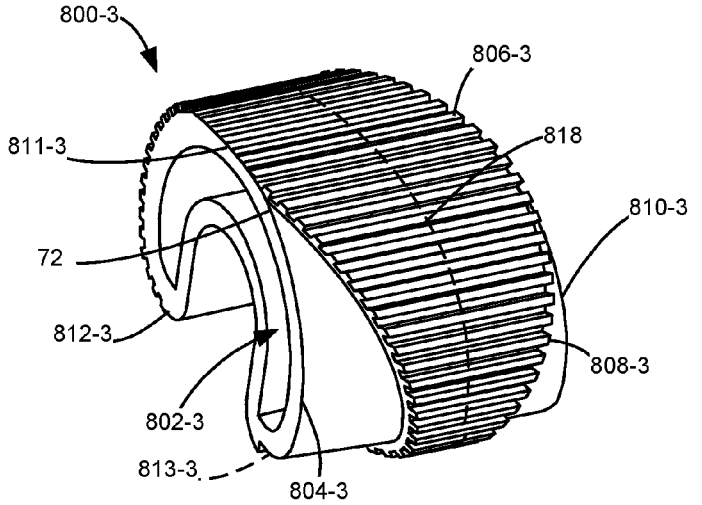
FIG. 14 is a perspective view of a third example embodiment of a pick tire having a tapering tread pattern useable with the pick roll of FIG. 4.

Referring now to FIGS. 12-14 various embodiments of pick tire 800 are illustrated. In FIG. 12, pick tire 800-1 is comprised of three D-shaped bands or sections, generally indicated by reference numeral 820. Each D-shaped section 820-1-820-3 has a base 804-1, a leading edge 812-1, a trailing edge 813-1, as indicated dashed lines, and a D-shaped opening 802-1. Outer sections 820-1, 820-3 are substantially identical having tread portions 821 circumferentially extending from leading edge 812-1 to transition point 72 between leading and trailing edges 812-1, 813-1 while middle or center band 820-2 has a tread portion 831 extending between leading and trailing edges 812-1, 813-1. On outer sections 820-1, 820-3, no tread is provided on tire base 804-1 between transition point 72 to trailing edge 813-1. Sections 820-1-820-3 would be seated in abutting arrangement on rim 702 between left and right flanges 706, 707 forming pick tire 800-1. Left and right edges of pick tire 800-1 are indicated at 811, 810. When mounted, the adjacent portions of section 820-1-820-3 between leading edge 812-1 and transition point 72 form wide tread portion 806 and the adjacent portions of section 820-1-820-3 and trailing edge 813-1 form narrow tread portion 808, each tread portion having the characteristic as previously described. Using separate outer and inner bands, each band type may be molded as an integral unit using a separate mold for the inner and outer band type. The need for special molds and/or post molding milling to remove tread to form the narrow tread portion 808 on pick tire 800 when pick tire 800 is molded as a single unit is obviated.

FIGS. 13-14 illustrate pick tires having tapering narrow tread portions. In FIG. 13 pick tire 800-2 has a stepped in tapering narrow tread portion 808-2. Pick tire 800-2 has left and right edges 810-2, 811-2 and D-shaped opening 802-2. Wide tread portion 806-2 extends between leading edge 812-2 and transition point 72 and between left and right edges 810-2, 811-2. Narrow tread portion 808-2 extends between trailing edge 813-2 and transition point 72 and, at transition point 72, is stepped inwardly from left and right edges 810-2, 811-2. Narrow tread portion 808-2 is illustrated as being centered between left and right edges 810-2, 811-2. Narrow tread portion 808-2 tapers inwardly from each side as it extends to trailing edge 813-2. Width tread portion 806-2 and narrow tread portion 808-2, each tread portion having the characteristic as previously described. As approximated by dashed lines 816, 817 pick tire 800-2 may be made from three bands as shown with pick tire 800-1. In FIG. 14, pick tire 800-3 has a non-stepped in tapering narrow tread portion 808-3 centered between left and right edges 810-3, 811-3. Pick tire 800-3 has D-shaped opening 802-3. Wide tread portion 806-3 extends between leading edge 812-3 and transition point 72 and between left and right edges 810-3, 811-3. Narrow tread portion 808-3 extends between trailing edge 813-3 and transition point 72 and, beginning at transition point 72 it begins to taper inwardly from left and right edges 810-3, 811-3 as it extends to trailing edge 813-3. Width tread portion 806-3 and narrow tread portion 808-3 have the characteristic as previously described. As approximated by dashed line 818 pick tire 800-3 may be made from two bands.

Figure 15:
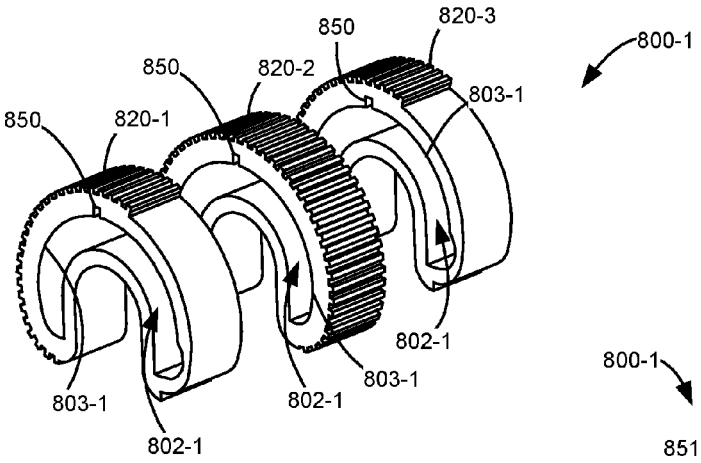
FIGS. 15-16 are perspective views of pick tire and hub using an alignment keyway and key, respectively.
Figure 17:
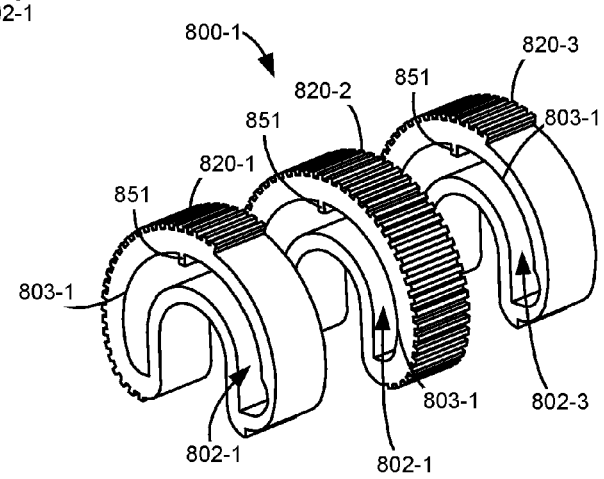
FIGS. 17-18 are perspective views of pick tire and hub using an alignment key and keyway, respectively.
Figure 16:
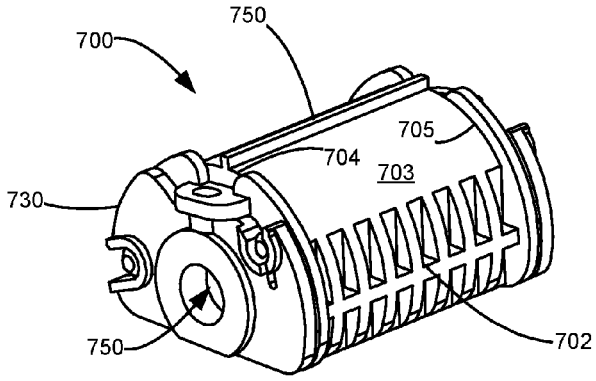
Figure 18:
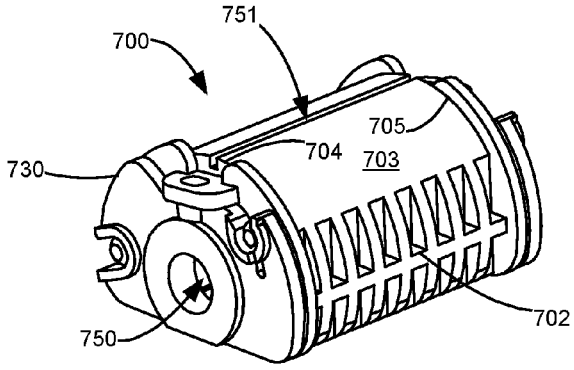

FIGS. 15-18 illustrate the use of alignment features on pick tire 800-1 and on hub assembly 700. FIGS. 15-16 illustrate the use of axially aligned keyways 850 provided in the walls 803-1 of center openings 802-1 of each of outer bands 820-1, 820-3 and inner band 820-2 with a corresponding key 750 provided on seating surface 703 axially extending between the left and right edges 704, 705 of rim 702. FIGS. 17-18 illustrate the use of axially aligned keys 851 provided on the walls 803-1 of center openings 802-1 and extending thereon of each of outer bands 820-1, 820-3 and inner band 802-2 with a corresponding keyway provided on seating surface 703 axially extending between the left and right edges 704, 705 of rim 702. The keyways 850 and corresponding key 750 and keys 851 and corresponding keyway 751 may be used to ensure that respective tread portions of outer bands 820-1, 820-3 remain aligned with those on inner band 820-2 and that the outer and inner bands 820-1-820-3 do not slip on rim 702 as media feeding forces are applied during media feeding. Multiple keys and keyways may be used as illustrated in FIG. 3 where three keys 750 are shown on rim 702 and three keyways 850 are shown in pick tire 800.

Figure 19:
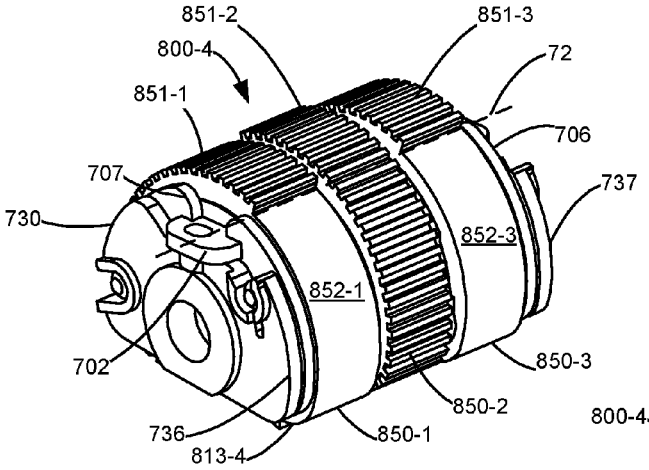
FIGS. 19-21 are left side, right side, and bottom perspective views of a pick roll using a further embodiment of a pick tire having three segments with the same tread configuration.
Figure 20:
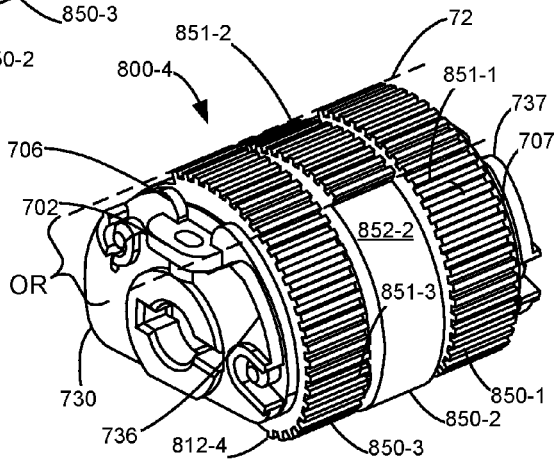
Figure 21:
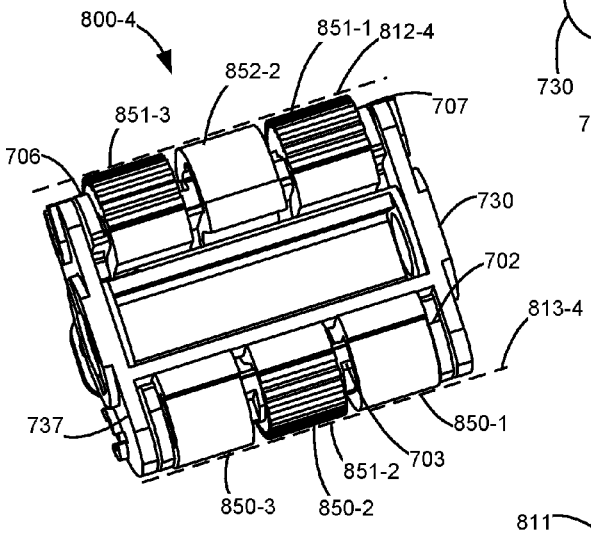

FIGS. 19-21 illustrate another embodiment where pick tire 800-4 is formed by three substantially identical bands comprised of outer bands 850-1, 850-3 and inner band 850-2 mounted on rim 702 with the outer bands 850-1, 850-3 having aligned tread portions 851-1, 851-3 and non-tread portions 852-1, 852-3. Inner band 850-2 has tread portion 851-2 and non-tread portion 852-2 that have the same circumferential lengths as those of respective tread portions 851-1, 851-3 and nontread portion 852-1, 852-3. Inner band 850-2 is flipped or rotated 180 degrees with respect to the two outer bands 850-1, 850-3. Tread portions 851-1, 851-3 begin at leading edge 812-4 and circumferentially extend to transition point 72 whereas tread portion 851-2 circumferentially extends from trailing edge 813-4 beyond transition point 72 creating an overlap region OR where tread is present across tire seating surface 703 of rim 702. As seen in FIG. 20, even though the wide tread portion from leading edge 812-4 is absent tread due to non-tread portion 852-2, pick tire 800-4 has a wide tread portion that effectively extends between left and right flanges 706,707 due to the presence of tread portions 851-1, 851-3 of outer tire bands 850-1, 850-3.

Figure 22:
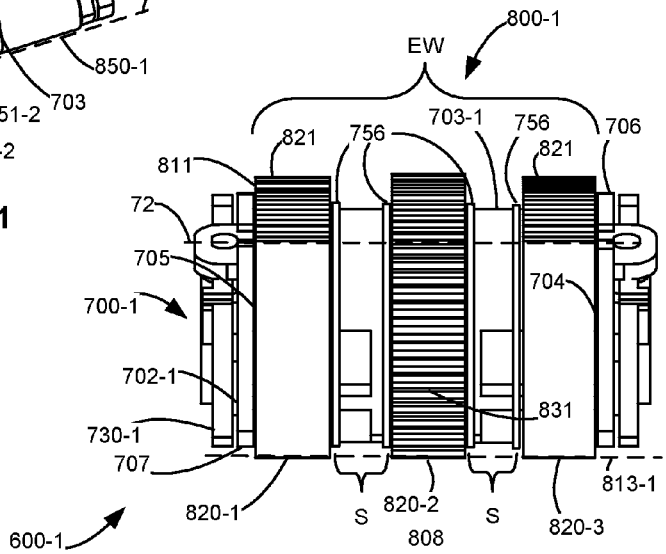
FIG. 22 is a perspective view of an extended width embodiment of a pick roll.

FIG. 22 illustrates an extended width pick tire 600-1 having hub assembly 700-1 and pick tire 800-1. Hub assembly 700-1 including rim 702-1 and shaft coupler 730-1 are substantially similar to hub assembly 700, rim 702 and shaft coupler 730 and similar elements will have the same or similar reference numerals to those used for hub assembly 700, rim 702 and shaft coupler 730 and a description of those similarities will not be repeated. Pick tire 800-1 and tire bands 820-1-820-3 have also been previously described. Hub assembly 700-1 is elongated axially to provide spaced apart tire bands 820-1-820-3. Tire seating surface 703-1 has a plurality of annular ribs 756. One pair of ribs 756 is centered between left and right flanges 704, 705 with inner band 820-2 seated therebetween. Outer band 820-1 is seated between right flange 707 and the adjacent annular rib 756 while outer band 820-3 is seated between left flange 706 and the adjacent annular rib 756. Center tire band 820-2 is axially separated equidistant from the other two bands by a distance indicated as S. Distance S may range from about 2 mm to about 10 mm. The spacing increases the effective width, indicated at EW, for pick tire 800-1 over pick tires such as that shown in FIG. 19. The annular ribs 756 inhibit the axial movement of the three tire bands over tire seating surface 703-1. Keys and keyways may also be used as previously described. The assembly should be symmetric to ensure straight feeding of the media sheet.

The range of tread widths of the pick tires 800, 800-1-800-4, is dependent on the media being fed. Typically, the narrowest media fed is 3"×5" (76.2 mm×127 mm) index cards with the shorter edge being the leading edge during feeding. For this media type, the maximum tread width (for example, wide tread portion 806 of pick tire 800) would be about 76.2 mm since overlap of the pick tire may lead to excessive wear of lift pad 48. We have found that the tread with of about 76.2 mm is also sufficient to feed Ledger, A4 and Letter media. For a minimum tread width, the tire tread should be wide enough to have control of the feeding of the media yet leave enough clearance with the sides of the media. For the 3×5 index card, 25 mm would be a good clearance on both sides yet maintain sufficient control over the media. As such, the minimum tread width would be about 25.4 mm. We have found that a pick tire having a wide tread portion of about 76.2 mm and a narrow tread portion of about 25.4 mm provides sufficient media force to feed media ranging from 3×5 index cards to A4 and Letter media.

The narrow tread portion should be reduced to the least width possible but still provide enough force to be able to push the media through the alignment apparatus and also be manufacturable. We have found 5 mm to be the narrowest, reliably manufacturable, tread width. For example, tread portion 831 of center band 820-2 of pick tire 800-1 would have a minimum width of 5 mm. Similarly, narrow tread portion 808 of pick 800 would have a minimum width of about 5 mm.

The tread width of the wide tread portion affects the media feeding force of the narrow tread portion according to the ratio given in Equation 1.

$$\frac{F_{MFFW}}{F_{MFFN}} \propto \left(\frac{T_W}{T_N}\right)^{0.35} \qquad \text{Equation 1}$$

where:

$F_{MMFW}$=Media Feeding Force of Wide Tread Portion in grams;

$F_{MFFN}$=Media Feeding Force of Narrow Tread Portion in grams;

$T_W$=Tread Width Wide Portion in mm; and $T_N$=Tread Width Narrow Portion in mm For $F_{MMFW}\cong 1000$ gm, $T_W\cong 26$ mm and $F_{MFFN}\cong 250$ gm, $T_N$ could be as low as 0.5 mm. However, a tread width this narrow would be hard to manufacture so a minimum width of approximately 5 mm was chosen which would result in a 45% reduction in the media feeding force provided by the narrow tread portion as compared to the media feeding force provided by the wide tread portion. To improve wear resistance, the widths of the narrow and wide tread portions may be increased further but this would also increase the media feeding forces.

Table 1 below provides some empirically determined tread width sizing and media feeding forces.

TABLE 1

| Tread Width Wide (mm) | Tread Width Narrow (mm) | Wide Tread Media Feeding Force - First Media Feeding Force (grams) | Narrow Tread Media Feeding Force - Second Media Feeding Force (grams) |
|---|---|---|---|
| 10 | 5 | 200 | 157 |
| 15 | 5 | 400 | 272 |
| 20 | 5 | 600 | 369 |
| 25 | 5 | 800 | 455 |
| 30 | 5 | 1000 | 534 |

The foregoing description of embodiments has been presented for purposes of illustration. It is not intended to be exhaustive or to limit the present disclosure to the precise steps and/or forms disclosed, and obviously many modifications and variations are possible in light of the above teaching. It is intended that the scope of the invention be defined by the claims appended hereto.

What is claimed is:

1. A media feed system in an image forming device, comprising:

a frame;

a media support for holding a media stack having one or more media sheets, the media support abutting the frame;

a shaft rotatably mounted to the frame and positioned above the media stack, the shaft operably coupleable to a drive source in the image forming device;

a pick roll coupled to the shaft and rotatable therewith to pick a sheet of media from the media stack and feed the picked media sheet into a media feed path in a media feed direction, the pick roll including:

a D-shaped hub coupled to the shaft; and a D-shaped pick tire mounted on the hub, the pick tire rotatable to contact the media sheet of the media stack at a pick position and to pick and move the media sheet in the media feed direction; the pick tire having a wide tread portion contiguous with a narrow tread portion, the wide tread portion having a first circumferential length, the narrow tread portion having a tread width that is less than a width of the wide tread portion, the narrow tread portion having a second circumferential length, the wide tread portion applying a first media feeding force that is greater than a second media feeding force applied by the narrow tread portion;

and, an aligner for aligning a leading edge of the picked media sheet to be transverse to the media feed direction, the aligner disposed downstream of the pick position at a distance that is less than a sum of the first and second circumferential lengths and greater than the first circumferential length, the aligner positioned transverse to the media feed path, wherein, when the pick tire initially contacts the media sheet at the pick position with the wide tread portion, the wide tread portion applies the first media feeding force to the media sheet to move the sheet in the media feed direction and into the media feed path, and, as the pick tire is further rotated the narrow tread portion contacts the picked media sheet to apply the second media feeding force allowing the leading edge of the media sheet to contact and align with the aligner.

2. The media feed system of claim 1, wherein the pick tire further comprises three tire bands, an inner tire band abuttingly positioned between two outer tire bands, the inner tire band having a circumferential tread length substantially equal to the sum of the first and second circumferential lengths and the two outer bands each having a circumferential tread length substantially equal to the first circumferential length.

3. The media feed system of claim 2, wherein the hub has one of an axial key and an axial keyway and each of the three tire bands has a corresponding one of an axial keyway and an axial key.

4. The media feed system of claim 2, wherein the hub has a width that is greater than a sum of widths of the inner and two outer bands, and, further wherein the inner band is spaced apart from the two outer bands.

5. The media feed system of claim 4, wherein the inner band is positioned between a first and a second alignment member radially depending from the hub and positioned about a centerline of the hub and one of the two outer bands is positioned in between a left flange of the hub and a third alignment member radially depending from the hub and spaced apart from the left flange of the hub and the other of the two outer bands is positioned in between a right flange of the hub and a fourth alignment member radially depending from the hub and spaced apart from the right flange of the hub.

6. The media feed system of claim 1, wherein the pick tire further comprises an inner band positioned in abutment between two outer bands, the inner band and the two outer bands being substantially identical, each band having a circumferential tread length substantially equal to the first circumferential length, and, further wherein the inner band is positioned on the hub opposite to each of the two outer bands.

7. The media feed system of claim 1, wherein the hub includes a rim and a shaft coupler removably coupled to the shaft with the rim being removably attached to the shaft coupler, and, when attached to the shaft coupler, rotatable with the shaft.

8. The media feed system of claim 1, wherein the narrow tread portion has a width that tapers inwardly from a right and a left edge of the pick tire beginning adjacent an end of the wide tread portion.

9. The media feed system of claim 1, wherein the narrow tread portion has a substantially constant width along the second circumferential length.

10. The media feed system of claim 1, wherein the aligner is a pair of bump align feed rolls.

11. The media feed system of claim 1, wherein the aligner is a gate rotatably mounted to the frame and coupleable to the drive source, and, when rotated into a first position, the gate is in the media feed path for contact with the leading edge of the picked media sheet, and, when rotated into a second position, the gate is out of the media feed path.

12. A media feed system in an image forming device, comprising:

a frame;

a media support for holding a media stack having one or more media sheets to be fed in a media feed direction along a media feed path, the media support abutting the frame;

a shaft rotatably mounted to the frame and positioned above the media stack, the shaft operably coupleable to a drive source in the image forming apparatus;

a pick roll coupled to the shaft and rotatable therewith to pick a topmost sheet of media from the media stack, the pick roll centered about a centerline of the media feed path, the pick roll including:

a hub mounted to the shaft so as to rotate therewith, the hub including:

a shaft coupler removably coupled to the shaft; and a D-shaped rim removably attached to the shaft coupler;

and, a D-shaped pick tire removably mounted on the rim, the pick tire contacting a topmost media sheet of the media stack at a pick position and drivable by the shaft to pick and move the topmost media sheet in the media feed direction into the media feed path; the pick tire having a wide tread portion contiguous with a narrow tread portion, the wide tread portion having a first circumferential length, the narrow tread portion having a tread width that is less than a width of the wide tread portion, the narrow tread portion having a second circumferential length, the wide tread portion applying a first media feeding force to the topmost media sheet that is greater than a second media feed force applied by the narrow tread portion to the topmost media sheet;

a feed roll pair mounted to the frame downstream of the pick roll in the media feed direction and forming a feed nip for receiving the picked media sheet, the feed nip positioned at a predetermined distance from the pick position that is about equal to a sum of the first and the second circumferential length; and an aligner for aligning a leading edge of the picked media sheet transverse to the media feed direction, the aligner coupleable to the drive source and moveable between a first position in the media feed path and a second position out of the media feed path, the aligner disposed between the pick mechanism and the feed roll pair and positioned transverse to the media feed direction, the aligner disposed downstream of the pick position at a distance that is less than a sum of the first and second circumferential lengths and greater than the first circumferential length, wherein, the pick tire is rotated to initially contact the topmost media sheet with the wide tread portion applying the first media feeding force to move the topmost media in the media feed direction, and as the pick tire is rotated the narrow tread portion then contacts the picked topmost media sheet to apply the second media feeding force allowing the leading edge of the picked media sheet to contact and align with the aligner, when in the first position, and further wherein, when the aligner is moved to the second position, the second media feeding force continues to move the picked media sheet into the feed nip of the feed roll pair.

13. The media feed system of claim 12, wherein the pick tire further comprises three tire bands, an inner tire band abuttingly positioned between two outer tire bands, the inner tire band having a circumferential tread length substantially equal to the sum of the first and second circumferential lengths and the two outer bands each having a circumferential tread length substantially equal to the first circumferential length.

14. The media feed system of claim 13, wherein the rim of the hub has a width that is greater than a sum of widths of the inner and two outer bands, and, further wherein the inner band is spaced apart from the two outer bands.

15. The media feed system of claim 12, wherein the pick tire further comprises an inner band positioned in abutment between two outer bands, the inner band and the two outer bands being substantially identical, each band having a circumferential tread length substantially equal to the first circumferential length, and, further wherein, the inner band is positioned opposite to each of the two outer bands.

16. The media feed system of claim 15, wherein the hub has one of an axial key and an axial keyway and each of the inner and outer bands has a corresponding one of an axial keyway and an axial key.

17. The media feed system of claim 12, wherein the narrow tread portion has a width that tapers inwardly from a right and a left edge of the pick tire beginning adjacent an end of the wide tread portion.

18. The media feed system of claim 12, wherein the narrow tread portion has a substantially constant width along the second circumferential length.

19. A media picking apparatus for an image forming device, the media picking apparatus comprising:

a media input tray for holding a stack of media sheets, the media input tray configured to accommodate one of a plurality of media types of different widths;

a controller;

a drive source in operable communication with the controller;

a frame mounted in the image forming apparatus;

a shaft rotatably mounted to the frame and coupled to the drive source in the image forming device;

a pick roll coupled to the shaft and rotatable therewith to pick a topmost sheet of media from the media stack, the pick roll centered about a centerline of the media feed path, the pick roll including:

a hub mounted to the shaft so as to rotate therewith, the hub including:

a shaft coupler coupled to the shaft; and a D-shaped rim removably attached to the shaft coupler;

and, a D-shaped pick tire removably mounted on the rim, the pick tire contacting a topmost media sheet of the stack of media sheets at a pick position and drivable by the shaft to pick and move the topmost media sheet in the media feed direction into a media feed path; the pick tire having a wide tread portion contiguous with a narrow tread portion, the wide tread portion having a first circumferential length, the narrow tread portion having a tread width that is less than a width of the wide tread portion, the narrow tread portion having a second circumferential length, the wide tread portion applying a first media feeding force that is greater than a second media feed force applied by the narrow tread portion;

and, an aligner for aligning a leading edge of the picked media sheet transverse to the media feed direction, the aligner coupleable to the drive source and moveable between a first position in the media feed path and a second position out of the media feed path, the aligner disposed between the pick mechanism and the feed roll pair and positioned transverse to the media feed direction, the aligner disposed downstream of the pick position at a distance that is less than a sum of the first and second circumferential lengths and greater than the first circumferential length, wherein the controller is configured to:

operate the drive source to rotate the pick roll in the media feed direction so that the pick tire initially contacts the topmost media sheet with the wide tread portion to apply the first media feeding force to the topmost media sheet so as to move in the media feed direction and to move the aligner into the first position, and as the pick tire continues to rotate the narrow tread portion contacts the picked media sheet to apply the second media feeding force allowing the leading edge of the picked media sheet to contact the aligner to align with the aligner; and operate the drive source to move the aligner to the second position and to continue rotating the pick roll in the media feed direction allowing the second media feeding force to continue to move the picked media sheet past the aligner.

20. The media picking apparatus of claim 19, wherein the pick tire further comprises three tire bands, an inner tire band positioned between two outer tire bands, the inner tire band having a circumferential tread length substantially equal to the sum of the first and second circumferential lengths and the two outer bands each having a circumferential tread length substantially equal to the first circumferential length, and wherein the rim of the hub has a width that is equal to greater than a sum of widths of the inner and two outer bands.

21. The media picking apparatus of claim 19, wherein the pick tire further comprises an inner band positioned in abutment between two outer bands, the inner band and the two outer bands being substantially identical, each band having a circumferential tread length substantially equal to the first circumferential length and further wherein the inner band is positioned opposite to each of the two outer bands.

22. A pick roll for a pick mechanism for feeding contacting a media sheet of a stack of media sheets disposed in a media feed system, the pick roll comprising:

a hub removably coupleable to a driven shaft of the pick mechanism, the hub rotatable with the shaft in a media feed direction, the hub having:

a shaft coupler coupleable to the shaft; and a D-shaped rim removably attached to the shaft coupler;

and, a D-shaped pick tire removably mountable on the rim for contacting the media sheet and drivable to pick and move the media sheet in a media feed direction into a media feed path, the pick tire having:

a tread disposed along an outer circumferential surface of the pick tire, the tread including a wide tread portion extending across a width of the pick tire and a narrow tread portion contiguous with the wide tread portion and centered about a circumferential centerline of the pick tire and having a width that is less than the width of the wide tread portion the wide tread portion having a first circumferential length and the narrow tread portion having a second circumferential length.

23. The pick roll of claim 22, wherein the pick tire further comprises three tire bands, an inner tire band positioned between two outer tire bands, the inner tire band having a circumferential tread length substantially equal to the sum of the first and second circumferential lengths and the two outer tire bands each having a circumferential tread length substantially equal to the first circumferential length, and wherein the rim of the hub has a width that is equal to or greater than a sum of widths of the inner and two outer tire bands.

24. The pick roll of claim 23, wherein the inner tire band is positioned between a first and a second alignment member depending from the rim of the hub and positioned about a centerline of the rim and one of the two outer tire bands is positioned in between a left flange of the rim and a third alignment member depending from the rim and spaced apart from the left flange of the rim and the other of the two outer tire bands is positioned in between a right flange of the rim and a fourth alignment member depending from the rim and spaced apart from the right flange of the rim.

25. The pick roll of claim 22, wherein the pick tire further comprises three substantially identical tire bands, an inner tire band positioned in abutment between two outer the bands, each tire band having a circumferential tread length substantially equal to the first circumferential length, and, further wherein the inner tire band is positioned opposite to each of the two outer bands.

26. The pick roll of claim 22, wherein the narrow tread portion has one of a substantially constant width along the second circumferential length and a width that tapers inwardly from a right and a left edge of the pick tire beginning adjacent an end of the wide tread portion.

27. The pick roll of claim 26, wherein the wide tread portion has a width that tapers outwardly along the right and the left edge of the pick tire ending adjacent the narrow tread portion.

* * * * *